US007903081B2

(12) United States Patent
Jang et al.

(10) Patent No.: US 7,903,081 B2
(45) Date of Patent: Mar. 8, 2011

(54) BACKLIGHT DRIVER, DISPLAY APPARATUS HAVING THE SAME AND METHOD OF DRIVING BACKLIGHT

(75) Inventors: Hyeon-Yong Jang, Osan-si (KR); Seong-Sik Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 809 days.

(21) Appl. No.: 11/846,655

(22) Filed: Aug. 29, 2007

(65) Prior Publication Data

US 2008/0055230 A1 Mar. 6, 2008

(30) Foreign Application Priority Data

Aug. 29, 2006 (KR) ..... 10-2006-0082382

(51) Int. Cl.
*G09G 3/36* (2006.01)

(52) U.S. Cl. ..... 345/102; 345/84; 345/87; 315/291

(58) Field of Classification Search ..... 345/84, 345/87, 102; 315/160, 209 R, 291, 307, 315/308, 312
See application file for complete search history.

(56) References Cited

U.S. PATENT DOCUMENTS

| | | | | |
|---|---|---|---|---|
| 7,106,294 | B2 * | 9/2006 | Kumamoto et al. | 345/102 |
| 7,183,722 | B2 * | 2/2007 | Oh et al. | 315/210 |
| 7,315,135 | B2 * | 1/2008 | Kang et al. | 315/247 |
| 7,391,163 | B2 * | 6/2008 | Jang | 315/219 |
| 7,468,722 | B2 * | 12/2008 | Ferguson | 345/102 |

FOREIGN PATENT DOCUMENTS

| | | |
|---|---|---|
| JP | 2002-056996 | 2/2002 |
| KR | 1020040089381 | 10/2004 |
| KR | 1020050099373 | 10/2005 |

* cited by examiner

*Primary Examiner* — Kimnhung Nguyen
(74) *Attorney, Agent, or Firm* — F. Chau & Associates, LLC

(57) ABSTRACT

A backlight driver includes an inverter controller, a dimming signal compensator and an inverter. The inverter controller generates a pulse width modulation signal in response to a control signal and outputs a first dimming signal that represents a duty ratio of the pulse width modulation signal and a second dimming signal that represents an amplitude of the pulse width modulation signal. The dimming signal compensator receives the first and second dimming signals, compares the first dimming signal with a predetermined reference duty ratio and compensates the second dimming signal in accordance with the compared result to generate a third dimming signal. The inverter outputs a driving voltage to drive the backlight and varies a voltage level of the driving voltage in response to the first and third dimming signals to control a brightness of the backlight.

20 Claims, 8 Drawing Sheets

BACKLIGHT DRIVER, DISPLAY APPARATUS HAVING THE SAME AND METHOD OF DRIVING BACKLIGHT

CROSS-REFERENCE TO RELATED PATENT APPLICATION

This application claims priority to Korean Patent Application No. 2006-82382, filed on Aug. 29, 2006, the contents of which are herein incorporated by reference in their entirety.

BACKGROUND OF THE INVENTION

1. Technical Field

The present disclosure relates to a backlight driver, a display apparatus having the same and a method of driving the backlight. More particularly, the present disclosure relates to a backlight driver capable of improving the response speed of the backlight and stabilizing the brightness, a display apparatus having the backlight driver and a method of driving the backlight.

2. Discussion of Related Art

In general, a liquid crystal display (LCD) includes an LCD panel that is illuminated by a backlight. A cold cathode fluorescent lamp (CCFL) is commonly employed as the LCD backlight.

Many applications require dimming capabilities, for example, to improve the contrast ratio of the display device and increase battery life. A dimming method has been utilized that controls the brightness of the backlight to increase a contrast ratio of the LCD or to decrease electric power consumption by the backlight. The dimming method can be classified into a pulse width modulation (PWM) control method and a current control method.

In dimming by a PWM control method, the CCFL is repeatedly turned on and off in accordance with the duty ratio of the PWM signal, thereby causing the CCFL brightness to vary. That is, the PWM control method involves switching the CCFL on and off at a regular interval to adjust the brightness of the backlight by changing the duty ratio.

Tube current is the current flowing through the CCFL tube after the tube has been lit. The CCFL brightness is directly proportional to the tube current. The current control method controls a voltage level applied to the CCFL to vary the tube current of the CCFL, thereby adjusting the brightness of the backlight. However, since the current control method is not designed to control the brightness in a low current range, the PWM control method has been mainly used for illumination control of the CCFL of the LCD backlight.

In the PWM control method, however, the response speed of the backlight decreases in the range of a low duty ratio of the PWM signal while the backlight is being dimmed, and a brightness blurring phenomenon can occur, thereby deteriorating the image display quality on the LCD.

SUMMARY OF THE INVENTION

In an exemplary embodiment of the present invention, a backlight driver includes an inverter controller, a dimming signal compensator and an inverter. The inverter controller generates a pulse width modulation signal in response to a control signal and outputs a first dimming signal that represents a duty ratio of the pulse width modulation signal and a second dimming signal that represents an amplitude of the pulse width modulation signal. The dimming signal compensator receives the first and second dimming signals and compares the first dimming signal with a predetermined reference duty ratio. The dimming signal compensator compensates the second dimming signal in accordance with the compared result to generate a third dimming signal. The inverter outputs a driving voltage to drive a backlight and varies a voltage level of the driving voltage in response to the first and third dimming signals to control a brightness of the backlight.

In an exemplary embodiment of the present invention, a display apparatus includes an inverter controller, a dimming signal compensator, an inverter a backlight and a display unit. The inverter controller generates a pulse width modulation signal in response to a control signal and outputs a first dimming signal that represents a duty ratio of the pulse width modulation signal and a second dimming signal that represents an amplitude of the pulse width modulation signal. The dimming signal compensator receives the first and second dimming signals and compares the first dimming signal with a predetermined reference duty ratio. The dimming signal compensator compensates the second dimming signal in accordance with the compared result to generate a third dimming signal. The inverter receives a power voltage and changes the power voltage into a driving voltage and varies a voltage level of the driving voltage in response to the first dimming signal and the third dimming signal. The backlight receives the driving voltage to generate light and the display unit displays an image using the light.

In an exemplary embodiment of the present invention, a method of driving a backlight includes receiving a first dimming signal that represents a duty ratio of a pulse width modulation signal and a second dimming signal that represents an amplitude of the pulse width modulation signal, comparing first dimming signal with a predetermined reference duty ratio, compensating the second dimming signal in accordance with the compared result to generate a third dimming signal, and receiving a power voltage to change the power voltage into a driving voltage for the backlight and varying a voltage level of the driving voltage in response to the first dimming signal and the third dimming signal to control a brightness of the backlight.

BRIEF DESCRIPTION OF THE DRAWINGS

The present invention will become readily apparent to those of ordinary skill in the art when descriptions of exemplary embodiments thereof are read with reference to the accompanying drawings.

DESCRIPTION OF EXEMPLARY EMBODIMENTS

Figure 1:
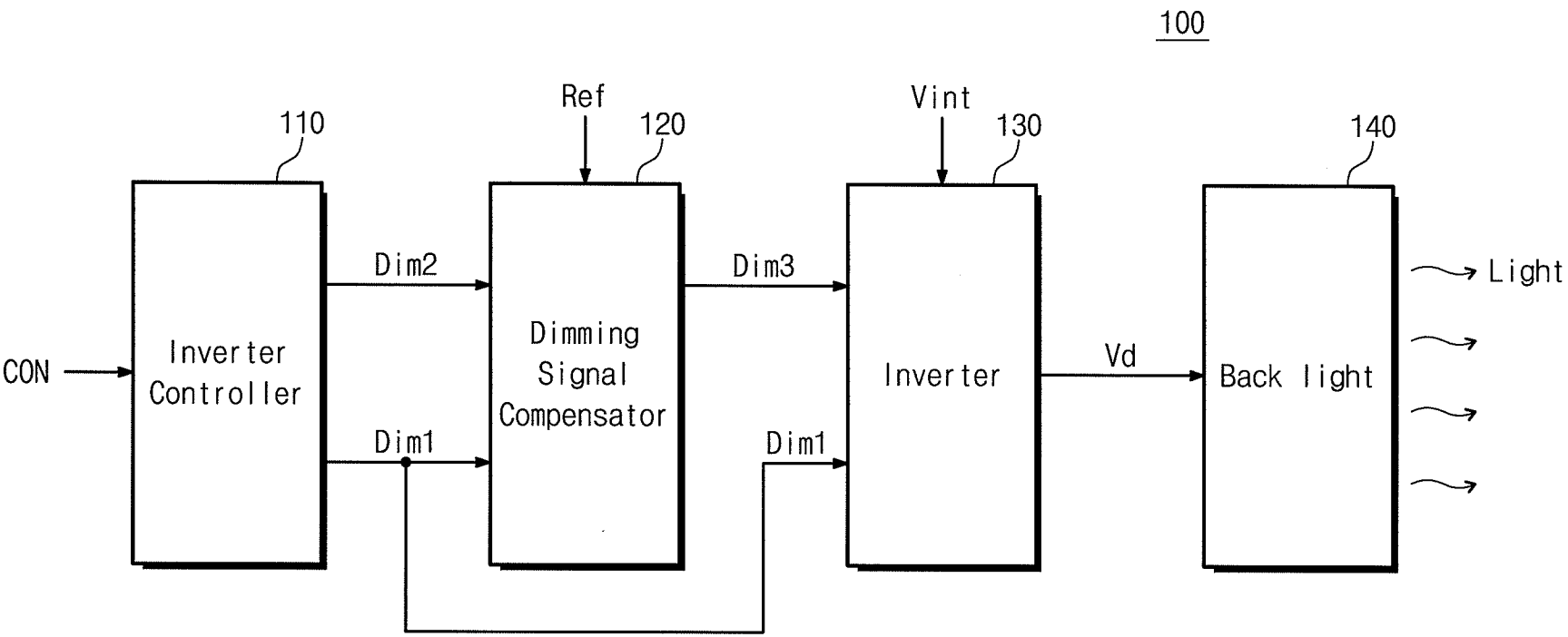
FIG. 1 is a block diagram showing a backlight driver according to an exemplary embodiment of the present invention.

Hereinafter, exemplary embodiments of the present invention will be described in detail with reference to the accompanying drawings. Like reference numerals may refer to similar or identical elements throughout the description of the figures.

Figure 2:
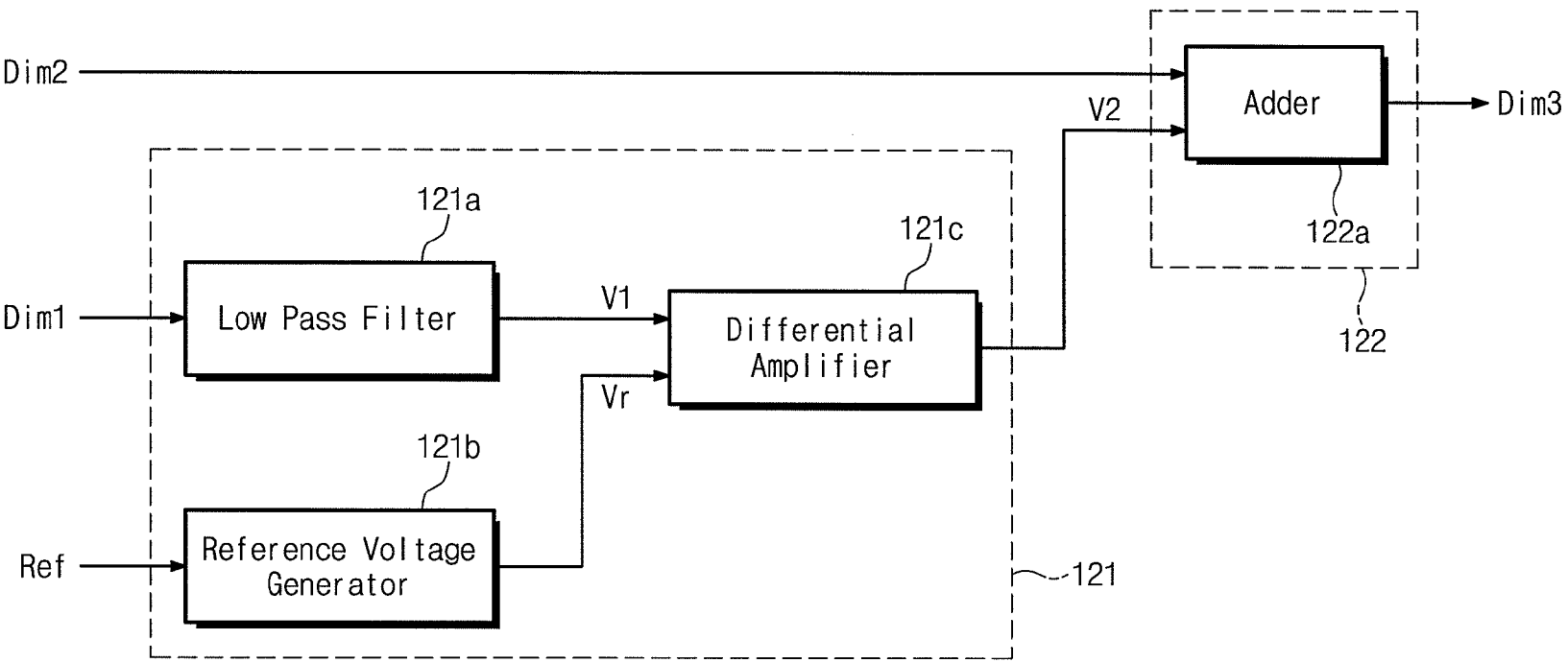
FIG. 2 is a block diagram of the dimming signal compensator of FIG. 1, according to an exemplary embodiment of the present invention.

FIG. 1 is a block diagram showing a backlight driver according to an exemplary embodiment of the present invention. FIG. 2 is a block diagram of the dimming signal compensator of FIG. 1, according to an exemplary embodiment of the present invention.

Referring to FIG. 1, a backlight driver 100 drives a backlight 140 disposed at the rear of a display unit (not shown) for backlighting of the display unit. The backlight driver 100 includes an inverter controller 110, a dimming signal compensator 120 and an inverter 130.

The inverter controller 110 generates a pulse width modulation (PWM) signal in response to a control signal CON from an external source. The PWM signal may be generated to adjust the brightness of the backlight 140 during a power saving mode or to enhance a contrast ratio C/R of the display unit. For example, the control signal CON may be generated according to a user's operation or based on an image data for the display.

The inverter controller 110 outputs a first dimming signal Dim1 representing the duty ratio of the PWM signal and a second dimming signal Dim2 representing the amplitude of the PWM signal, based on the PWM signal.

The dimming signal compensator 120 receives the first dimming signal Dim1 and the second dimming signal Dim2 outputted from the inverter controller 110. The dimming signal compensator 120 compares the first dimming signal Dim1 with a predetermined reference duty ratio Ref and compensates the second dimming signal Dim2 in accordance with the compared result to generate a third dimming signal Dim3.

Referring to FIG. 2, the dimming signal compensator 120 includes a comparing part 121 and an adding part 122. The comparing part 121 includes a low pass filter 121*a*, a reference voltage generator 121*b* and a differential amplifier 121*c*. The adding part 122 includes an adder 122*a*.

The comparing part 121 outputs a difference value that is the difference between the first dimming signal Dim1 and the reference duty ratio Ref when the first dimming signal Dim1 is smaller than the reference duty ratio Ref, and outputs the difference value equal to zero when the first dimming signal Dim1 is equal to or larger than the reference duty ratio Ref. For example, the reference duty ratio Ref may be less than 30%.

The low pass filter 121*a* converts the first dimming signal Dim1 into a first voltage V1. The reference voltage generator 121*b* outputs a reference voltage Vr corresponding to the reference duty ratio Ref. The differential amplifier 121*c* outputs a second voltage V2 corresponding to the difference between the first voltage V1 and the reference voltage Vr.

The adder 122*a* adds the second voltage V2 and the second dimming signal Dim2 to generate the third dimming signal Dim3. For example, the adder 122*a* may include an operational amplifier.

As shown in FIG. 1, the inverter 130 receives an inverter voltage Vint that is a direct current voltage from an external source and changes the inverter voltage Vint into a driving voltage Vd that is an alternating current voltage to provide the backlight 140 with the driving voltage Vd. Thus, the backlight 140 generates light in response to the driving voltage Vd. Although not shown in FIGS. 1 and 2, the backlight 140 includes at least one lamp, such as for example, a cold cathode fluorescent lamp (CCFL), which receives the driving voltage Vd to generate the light.

The inverter 130 intermittently provides the backlight 140 with the driving voltage Vd in response to the first dimming signal Dim1 and the third dimming signal Dim3, such that the lamp of the backlight 140 is repeatedly turned on and off and the overall brightness of the backlight 140 may be controlled.

Figure 3:
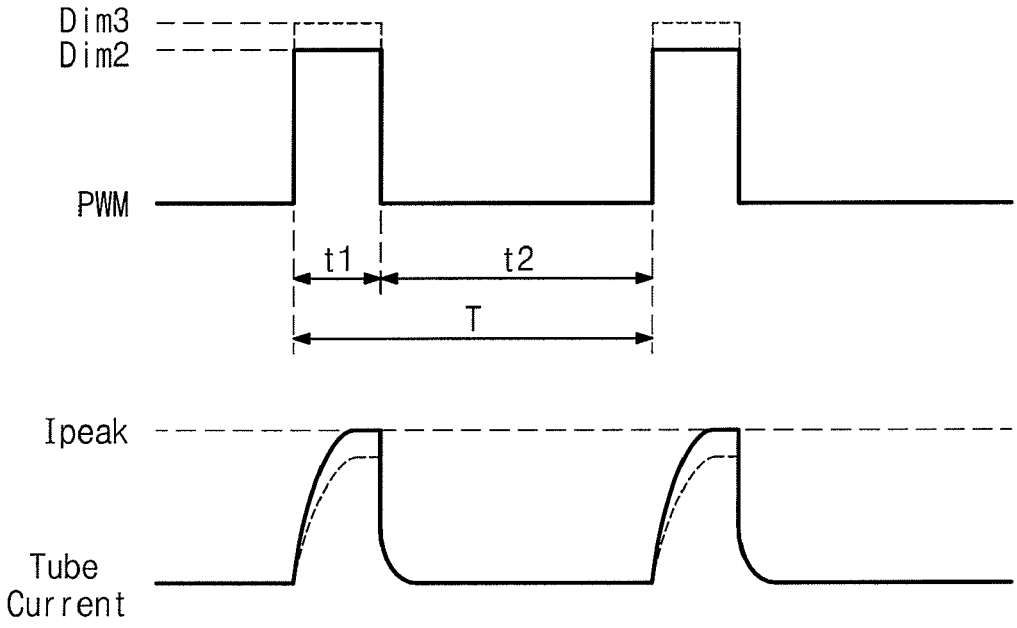
FIG. 3 is a waveform diagram showing the tube current of a cold cathode fluorescent lamp according to a pulse width modulation signal.

FIG. 3 is a waveform diagram showing the tube current of the CCFL according to the PWM signal.

Referring to FIGS. 1 and 3, the PWM signal PWM is divided into a first period t1, in which the lamp of the backlight 140 is turned on, and a second period t2 where the lamp of the backlight 140 is turned off. A ratio of the first period t1 to one period T of the PWM signal PWM is defined as the duty ratio t1/T. In an exemplary embodiment of the present invention, the first dimming signal Dim1 and the second dimming signal Dim2 are determined by the duty ratio t1/T and the amplitude of the PWM signal PWM, respectively.

The third dimming signal Dim3 is generated by adding the difference value between the first dimming signal Dim1 and the reference duty ratio Ref to the second dimming signal Dim2. Thus, when the first dimming signal Dim1 is smaller than the reference duty ratio Ref, the PWM signal PWM having an amplitude corresponding to the third dimming signal Dim3 that is larger than the second dimming signal Dim2 is applied to the inverter 130.

In an exemplary embodiment of the present invention, the inverter 130 applies the driving voltage Vd corresponding to the third dimming signal Dim3 to the backlight 140 during the first period t1.

As shown in FIG. 3, the tube current of the lamp increases to a peak tube current Ipeak when the driving voltage corresponding to the third dimming signal Dim3 is applied to the backlight 140, in comparison with when the driving voltage corresponding to the second dimming signal Dim2 is applied to the backlight 140, and the response speed of the backlight 140 may be improved.

Figure 4:
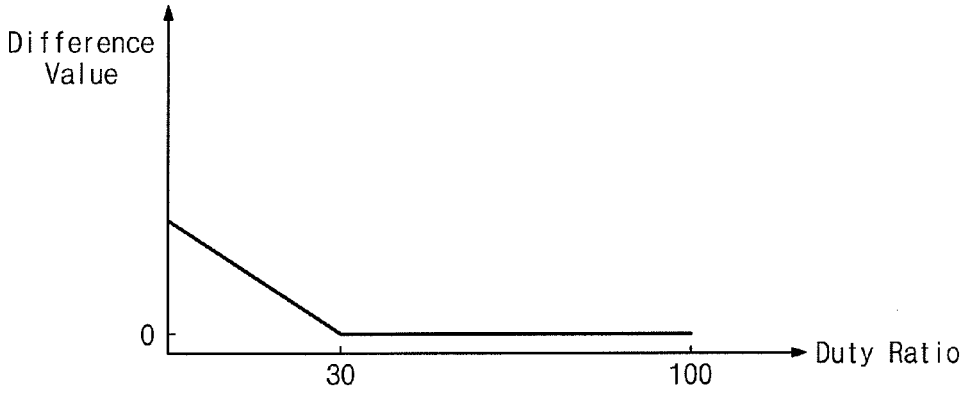
FIG. 4 is a graph showing the difference value between the tube current and the peak tube current in relation to the duty ratio.
Figure 5:
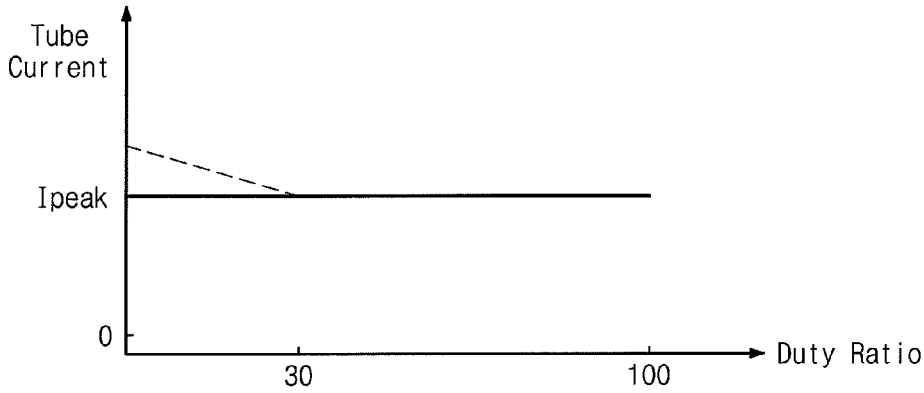
FIG. 5 is a graph showing the tube current in relation to the duty ratio.

FIG. 4 is a graph showing the difference value between the tube current and the peak tube current in relation to the duty ratio. FIG. 5 is a graph showing the tube current in relation to the duty ratio.

Referring to FIGS. 4 and 5, assuming that the reference duty ratio Ref is, for example, about 30%, the difference value increases as the first dimming signal Dim1 decreases where the duty ratio is less than 30%.

Meanwhile, the tube current of the lamp may be increased in proportion to the difference value when the duty ratio is less than 30%. The tube current of the lamp may be substantially equal to the peak tube current Ipeak that is an instantaneous current when the duty ratio is 100%.

As shown in FIGS. 3 and 5, the period during which the voltage level of the driving voltage reaches to a target driving voltage is shortened even though the voltage level of the driving voltage increases in proportion to the difference value when the duty ratio decreases during the period where the duty ratio is less than 30%, so that the tube current of the lamp is maintained at the peak tube current Ipeak. In an exemplary embodiment of the present invention, the target driving voltage increases when the duty ratio decreases during the period where the duty ratio is less than about 30%, and the time in which the tube current of the lamp reaches the peak tube current Ipeak is shortened during the period where the duty ratio is less than about 30%, and the response speed of the backlight 140 may be improved.

Figure 6:
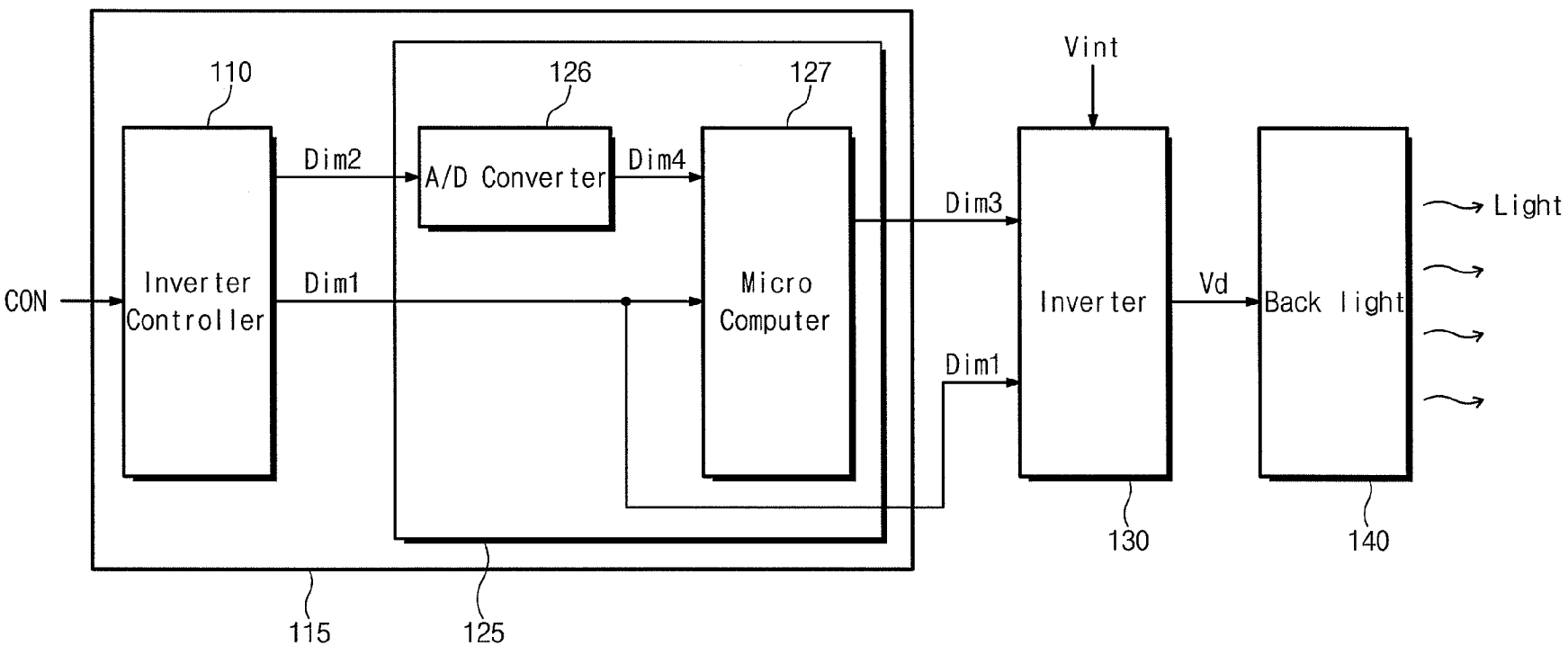
FIG. 6 is a block diagram showing a backlight driver according to an exemplary embodiment of the present invention.

FIG. 6 is a block diagram showing a backlight driver according to an exemplary embodiment of the present invention. In FIG. 6, the same reference numerals denote the same elements in FIG. 1, and thus further descriptions of the common elements will be omitted in the interests of brevity.

Referring to FIG. 6, a backlight driver 105 includes an inverter controller 110, a dimming signal compensator 125 and an inverter 130.

The dimming signal compensator 125 includes an analog-to-digital (A/D) converter 126 and a microcomputer 127. The A/D converter 126 receives a second dimming signal Dim2 outputted from the inverter controller 110 to output a fourth dimming signal Dim4. The AND converter 126 converts the second dimming signal Dim2 in an analog form to the fourth dimming signal Dim4 in a digital form. A first dimming signal Dim1 from the inverter controller 110 and the fourth dimming signal Dim4 are applied to the microcomputer 127.

The microcomputer 127 is programmed to compare the first dimming signal Dim1 with a predetermined reference duty ratio and add a difference value between the first dimming signal Dim1 and the reference duty ratio to the fourth dimming signal Dim4 to generate a third dimming signal Dim3. For example, the microcomputer 127 outputs the third dimming signal Dim3 that is equal to a sum of the fourth dimming signal Dim4 and the difference value when the first dimming signal Dim1 is smaller than the reference duty ratio, and outputs the fourth dimming signal Dim4 as the third dimming signal Dim3 when the first dimming signal Dim1 is equal to or larger than the reference duty ratio.

Although not shown as such in FIG. 6, the A/D converter 126 may be built in the microcomputer 127. The backlight driver 105 may include a control board 105 on which the inverter controller 110 is mounted. The dimming signal compensator 125 may be mounted on the control board 105.

Figure 7:
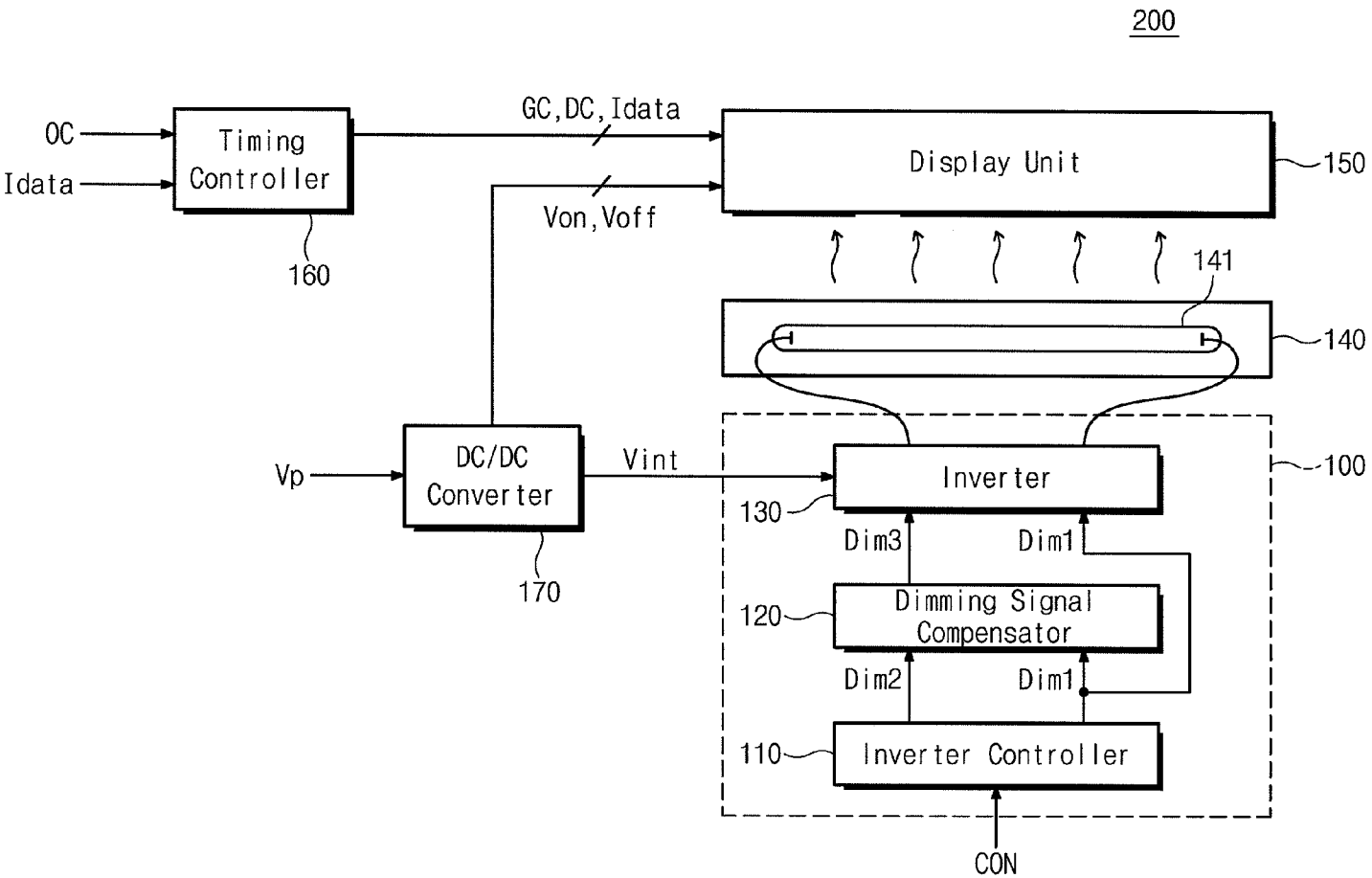
FIG. 7 is a block diagram showing a display apparatus having the backlight driver of FIG. 1, according to an exemplary embodiment of the present invention.

FIG. 7 is a block diagram showing a display apparatus having the backlight driver of FIG. 1, according to an exemplary embodiment of the present invention. In FIG. 7, the same reference numerals denote the same elements in FIG. 1, and thus further descriptions of the common elements will be omitted.

Referring to FIG. 7, a display apparatus 200 includes a display unit 150, a timing controller 160 and a DC/DC converter 170, a backlight 140 and a backlight driver 100.

The backlight 140 is arranged in the lower portion of the display unit 150 and includes at least one CCFL 141. The CCFL 141, which is connected to the inverter 130 of the backlight driver 100 to receive the driving voltage, generates light to provide the display unit 150 with the light. The inverter 130 controls the tube current of the CCFL 141, for example, so that brightness of the backlight 140 is controlled.

The display unit 150 displays an image using the light emitted from the backlight 140.

The timing controller 160 receives various control signals OC and an image data Idata from an external device. The timing controller 160 changes the various control signals OC into a data control signal DC and a gate control signal GC to output the data control signal DC and the gate control signal GC and outputs the image data Idata at an appropriate time.

The display unit 150 includes a liquid crystal display (LCD) panel displaying the image, a gate driving circuit and a data driving circuit driving the LCD panel. The gate driving circuit outputs a gate signal in response to the gate control signal GC, and the data driving circuit changes the image data Idata into a pixel voltage to output the pixel voltage in response to the data control signal DC. Thus, the LCD panel controls an arrangement of a liquid crystal layer in response to the gate signal and the pixel voltage to control a transmittance of the light provided from the backlight 140, so that the LCD panel may display a desired image thereon.

The DC/DC converter 170 receives a power voltage Vp from an exterior and changes the power voltage Vp into a driving voltage (i.e., a gate-on voltage Von or a gate-off voltage Voff, which are applied to the gate driving circuit) for the display unit 150. The DC/DC converter 170 changes the power voltage Vp into the inverter voltage Vint that is applied to the inverter 130.

Figure 8:
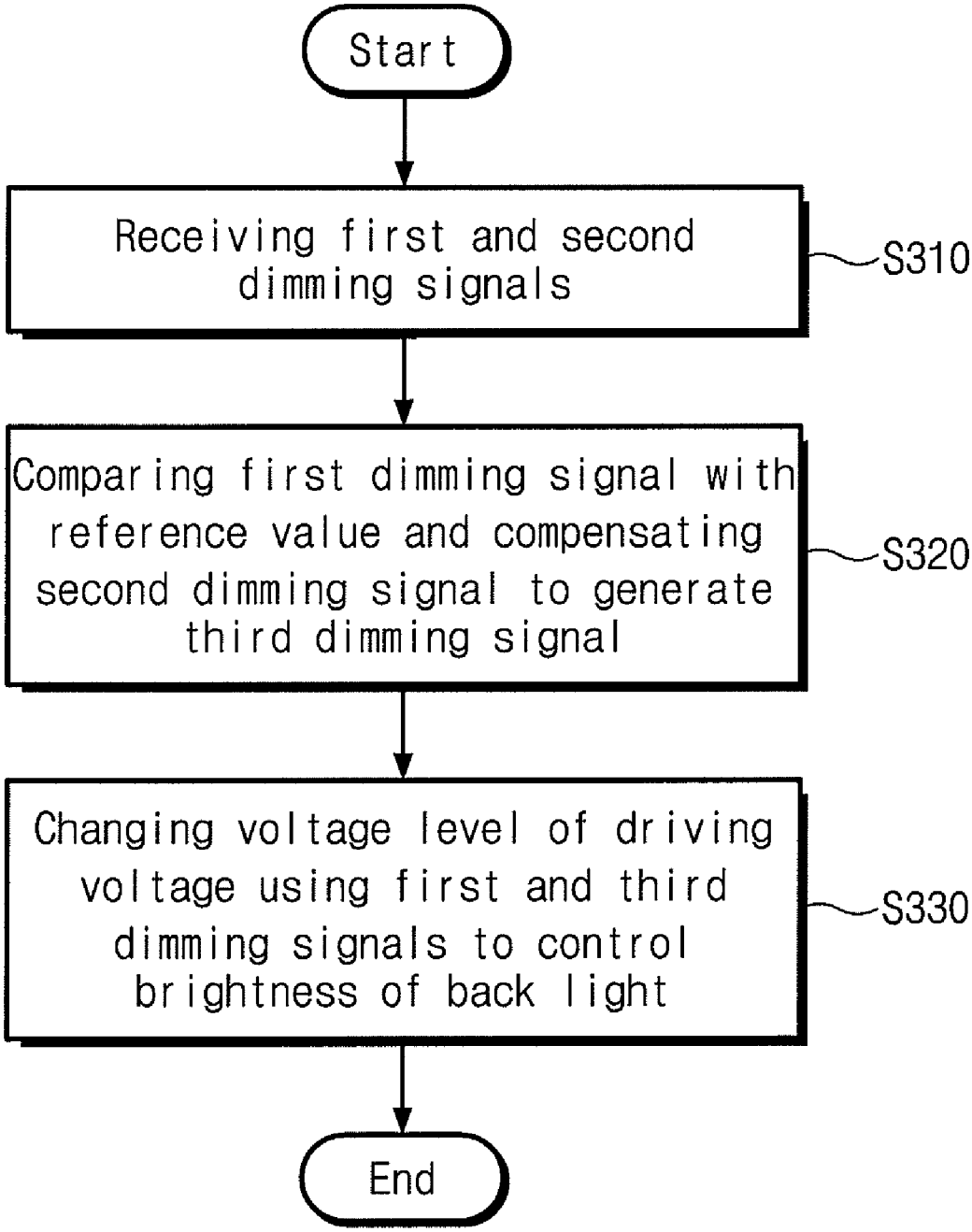
FIG. 8 is a flowchart illustrating a method of driving the backlight driver of FIG. 1, according to an exemplary embodiment of the present invention.
Figure 9:
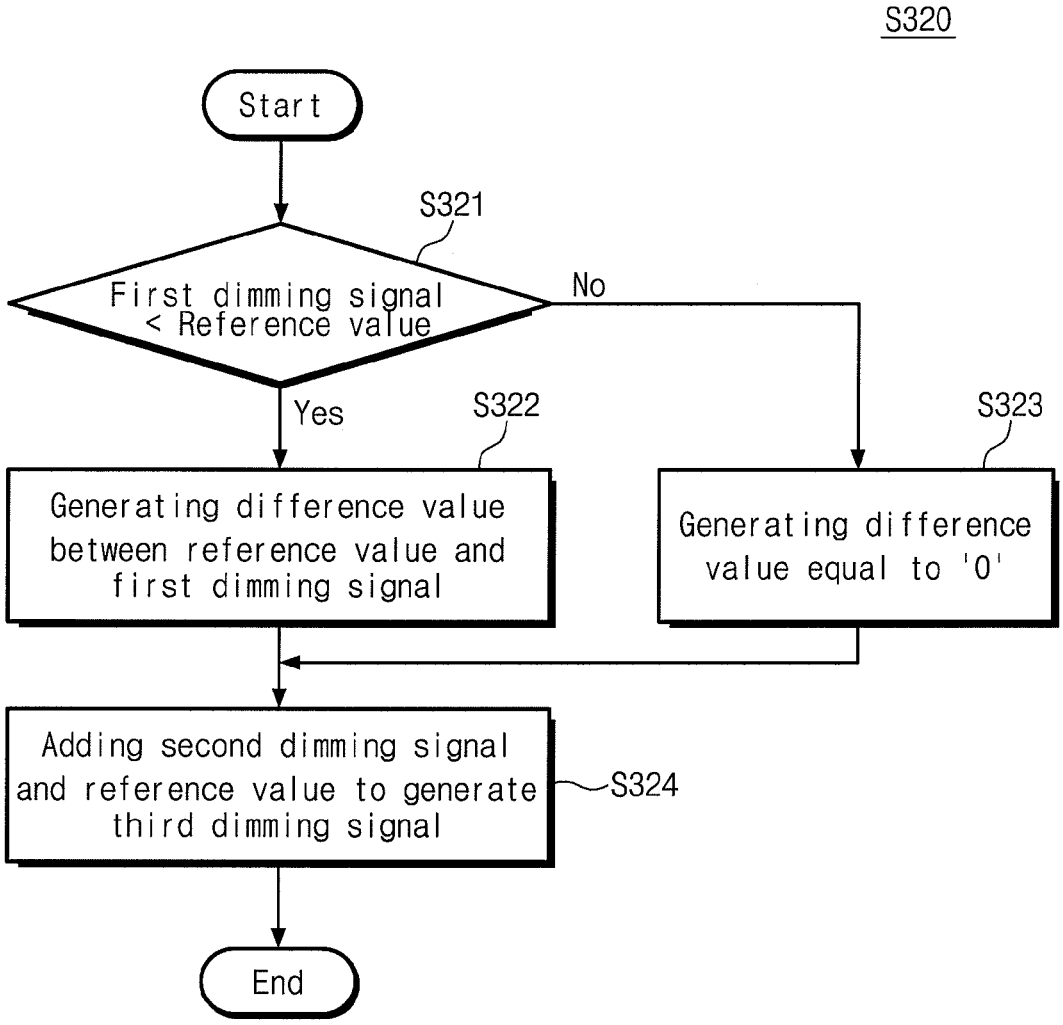
FIG. 9 is a flowchart illustrating the step 320 of FIG. 8, according to an exemplary embodiment of the present invention.

FIG. 8 is a flowchart illustrating a method of driving the backlight driver shown in FIG. 1, according to an exemplary embodiment of the present invention. FIG. 9 is a flowchart illustrating the step 320 of FIG. 8, according to an exemplary embodiment of the present invention.

Referring to FIG. 8, a first dimming signal representing a duty ratio of a PWM signal and a second dimming signal representing an amplitude of the PWM signal are received from an external source (S310). The first dimming signal is compared with a predetermined reference value (a reference duty ratio). According to the compared result, the second dimming signal is compensated to generate a third dimming signal (S320).

When a power voltage is input from an external source, the power voltage is changed into a driving voltage for a backlight, and a voltage level of the driving voltage is changed in response to the first and third dimming signals to control brightness of the backlight (S330).

As shown in FIG. 9, in the comparing of the first dimming signal and the predetermined reference value (S320), the first dimming signal is compared with the predetermined reference value to determine whether or not the predetermined reference value is smaller than the first dimming signal (S321).

When the first dimming signal is smaller than the reference value, a difference value between the first dimming signal and the reference value is output (S322). The difference value equal to zero is output when the first dimming signal is equal to or larger than the reference value (S323).

Next, the third dimming signal is generated by adding the difference value and the second dimming signal (S323).

According to an exemplary embodiment of the present invention, when the first dimming signal representing the duty ratio of the PWM signal is smaller than the predetermined reference duty ratio, the second dimming signal representing the amplitude of the PWM signal increases by the difference value, and the response speed may be improved when controlling the brightness of the backlight and the brightness blurring phenomenon may be prevented.

According to an exemplary embodiment of the present invention, the backlight driver may prevent deterioration of the response speed of the backlight even when the duty ratio is small.

Although the exemplary embodiments of the present invention have been described in detail with reference to the accompanying drawings for the purpose of illustration, it is to be understood that the inventive processes and apparatus should not be construed as limited thereby. It will be apparent to those of ordinary skill in the art that various changes and modifications to the foregoing exemplary embodiments can be made without departing from the scope of the present invention as defined by the appended claims, with equivalents of the claims to be included therein.

What is claimed is:

1. A backlight driver comprising:

an inverter controller generating a pulse width modulation signal in response to a control signal and outputting a first dimming signal that represents a duty ratio of the pulse width modulation signal and a second dimming signal that represents an amplitude of the pulse width modulation signal;

a dimming signal compensator receiving the first and second dimming signals and comparing the first dimming signal with a predetermined reference duty ratio to compensate the second dimming signal in accordance with the compared result and generate a third dimming signal; and an inverter outputting a driving voltage to drive a backlight and varying a voltage level of the driving voltage in response to the first and third dimming signals to control a brightness of the backlight.

2. The backlight driver of claim 1, wherein the dimming signal compensator comprises:

a comparing part comparing the first dimming signal with the reference duty ratio to output a difference value that is the difference between the first dimming signal and the reference duty ratio; and an adding part adding the difference value and the second dimming signal.

3. The backlight driver of claim 2, wherein the comparing part outputs the difference value when the first dimming signal is smaller than the reference duty ratio and outputs zero when the first dimming signal is equal to or larger than the reference duty ratio.

4. The backlight driver of claim 3, wherein the reference duty ratio is less than about 30%.

5. The backlight driver of claim 2, wherein the comparing part comprises:

a low pass filter converting the first dimming signal to a first voltage;

a reference voltage generator outputting a reference voltage corresponding to the reference duty ratio; and a differential amplifier outputting a second voltage corresponding to a difference between the first voltage and the reference voltage.

6. The backlight driver of claim 5, wherein the adding part comprises an adder adding the second voltage and the second dimming signal to generate the third dimming signal.

7. The backlight driver of claim 6, wherein the adder comprises an operational amplifier.

8. The backlight driver of claim 1, wherein the dimming signal compensator comprises a microcomputer that is programmed to compare the first dimming signal with the reference duty ratio and add a difference value that is the difference between the first dimming signal and the reference duty ratio to the second dimming signal to generate the third dimming signal.

9. The backlight driver of claim 8, wherein the microcomputer comprises an analog-to-digital converter converting the second dimming signal in an analog form into a fourth dimming signal in a digital form.

10. The backlight driver of claim 9, wherein the microcomputer outputs the third dimming signal that is equal to a sum of the fourth dimming signal and the difference value when the first dimming signal is smaller than the reference duty ratio, and outputs the fourth dimming signal as the third dimming signal when the first dimming signal is equal to or larger than the reference duty ratio.

11. The backlight driver of claim 1, further comprising a control board on which the inverter controller is mounted, and wherein the dimming signal compensator is mounted on the control board.

12. A display apparatus comprising:

an inverter controller generating a pulse width modulation signal in response to a control signal and outputting a first dimming signal that represents a duty ratio of the pulse width modulation signal and a second dimming signal that represents an amplitude of the pulse width modulation signal;

a dimming signal compensator receiving the first and second dimming signals and comparing the first dimming signal with a predetermined reference duty ratio to compensate the second dimming signal in accordance with the compared result and generate a third dimming signal;

an inverter receiving a power voltage to change the power voltage into a driving voltage and varying a voltage level of the driving voltage in response to the first and third dimming signals;

a backlight receiving the driving voltage to generate light; and a display unit displaying an image using the light.

13. The display apparatus of claim 12, wherein the dimming signal compensator comprises:

a comparing part comparing the first dimming signal with the reference duty ratio to output a difference value between the first dimming signal and the reference duty ratio; and an adding part adding the difference value and the second dimming signal.

14. The display apparatus of claim 13, wherein the comparing part outputs the difference value when the first dimming signal is smaller than the reference duty ratio, and outputs the difference value that is equal to zero when the first dimming signal is equal to or larger than the reference duty ratio.

15. The display apparatus of claim 12, wherein the backlight comprises at least one lamp that receives the driving voltage to generate the light.

16. The display apparatus of claim 15, wherein the lamp comprises a cold cathode fluorescent lamp.

17. The display apparatus of claim 12, wherein the display unit comprises a liquid crystal display panel that receives the light to display an image.

18. A method of driving a backlight, the method comprising:

receiving a first dimming signal that represents a duty ratio of a pulse width modulation signal and a second dimming signal that represents an amplitude of the pulse width modulation signal;

comparing the first dimming signal with a predetermined reference duty ratio;

compensating the second dimming signal in accordance with the compared result to generate a third dimming signal; and receiving a power voltage to change the power voltage into a driving voltage for the backlight and varying a voltage level of the driving voltage in response to the first and third dimming signals to control a brightness of the backlight.

19. The method of claim 18, wherein the comparing of the first dimming signal with the predetermined reference duty ratio comprises:

outputting a difference value that is the difference between the first dimming signal and the reference duty ratio when the first dimming signal is smaller than the reference duty ratio; and outputting zero when the first dimming signal is equal to or larger than the reference duty ratio.

20. The method of claim 19, wherein the third dimming signal is generated by adding the difference value and the second dimming signal.

* * * * *